United States Patent [19]

Clark et al.

[11] 4,059,065

[45] Nov. 22, 1977

[54] SEMISUBMERSIBLE LOADING MOORING AND STORAGE FACILITY

[75] Inventors: Robert L. Clark, Greenlawn, N.Y.; Paul C. Dahan, Pittstown, N.J.

[73] Assignee: Mobil Oil Corporation, New York, N.Y.

[21] Appl. No.: 766,163

[22] Filed: Feb. 7, 1977

[51] Int. Cl.[2] ..... B65D 89/10

[52] U.S. Cl. ..... 114/256

[58] Field of Search ..... 114/256, 74 T, 264, 114/265, 267; 9/8 R, 8 P; 166/.5; 61/87, 88, 89, 101; 220/9 LG, 85

[56] References Cited

U.S. PATENT DOCUMENTS

| | | | |
|---|---|---|---|
| 2,631,558 | 3/1953 | Harris | 114/256 |
| 2,696,185 | 12/1954 | Snoddy | 114/74 T |
| 2,731,168 | 1/1956 | Watts | 114/256 |
| 3,507,238 | 4/1970 | Chow | 114/256 |
| 3,727,418 | 4/1973 | Glazier | 220/9 LG |
| 3,880,102 | 4/1975 | Biewer | 114/256 |
| 3,943,724 | 3/1976 | Banzoli et al. | 114/256 |

*Primary Examiner*—Trygve M. Blix
*Assistant Examiner*—Jesus D. Sotelo
*Attorney, Agent, or Firm*—C. A. Huggett; Drude Faulconer

[57] ABSTRACT

A semisubmersible, loading, mooring and storage (LMS) facility for handling petroleum products at offshore locations. The LMS facility is comprised of a submerged storage section and a central tower section. The submerged storage section is comprised of a plurality of dual crude/water tanks, each of which has a flexible diaphragm therein to prevent any contact between the crude and the water. The central tower section contains crude only tanks through which the LMS facility is loaded and offloaded with crude and has an offloading and mooring structure on the top thereof. When the LMS facility is in an operable position and the dual tanks are filled with water, the profile of the LMS facility in the water is fixed and will not substantially change during loading or offloading of crude. The LMS facility is loaded by flowing crude into the crude only tanks and then filling the dual tanks from crude only tanks at a rate necessary to compensate for the water being displaced from the dual tanks. The LMS facility is offloaded by flowing water into the dual tanks to displace crude from the dual tanks into the crude only tanks. Crude from the crude only tanks is loaded onto a vessel at a rate to compensate for the water being flowed into the dual tanks.

13 Claims, 7 Drawing Figures

FIG. 3
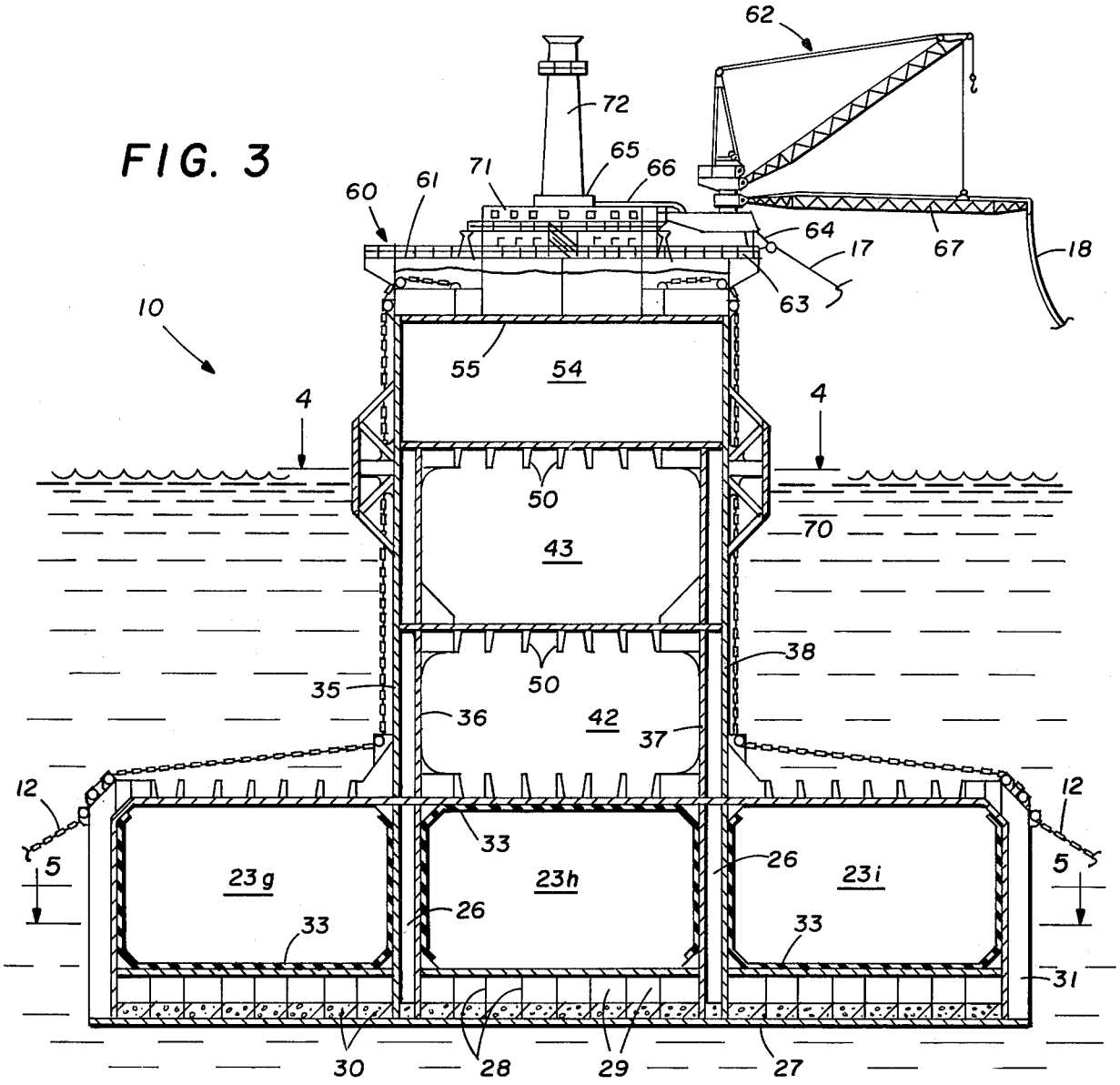
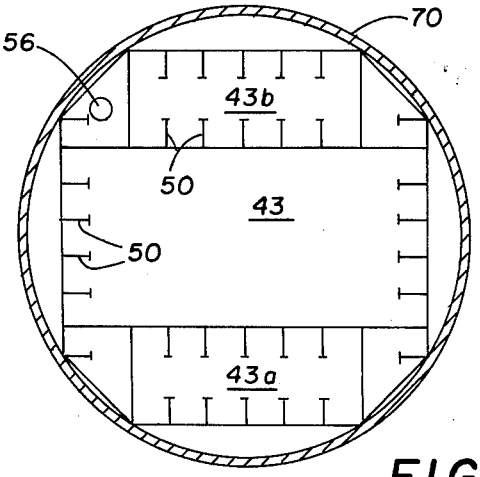
FIG. 4
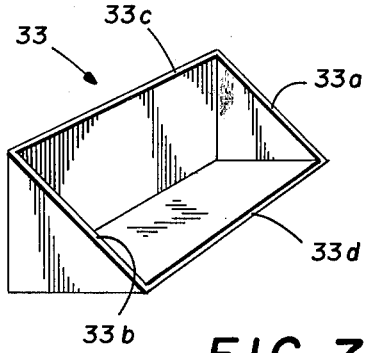
FIG. 7

SEMISUBMERSIBLE LOADING MOORING AND STORAGE FACILITY

BACKGROUND OF THE INVENTION

This invention relates to an offshore storage facility and more particularly relates to a semisubmersible combined loading, mooring and storage facility for handling petroleum products and offshore locations.

A major consideration in the production of petroleum products from offshore deposits is the handling and transportation of such products once they have been produced. If feasible, it is usually desirable to lay submerged pipelines from the production site to short so that flow of products may be continuous regardless of weather or other adverse conditions. However, in many areas of the world where offshore production exists, the laying of submerged pipelines is infeasible due to a variety of reasons, e.g., distance to shore, uneveness of the marine bottom, etc. In such areas, other means must be provided to handle the products so that production may continue without prolonged interruptions.

In most instances where pipelines are unavailable, the petroleum products are accumulated in storage facilities near the production site and then loaded onto tankers for transportation to shore. The storage facilities which have been proposed for such use are of many basic types: (1) storage tanks which are affixed to and form an integral part of a production platform; (2) completely submerged storage tanks which rest directly on the marine bottom; (3) floating storage tanks such as surplus tankers, etc.; and (4) semisubmersible storage tanks which have a lower submerged section and an upper section affixed thereto which normally extends above the waterline when in an operable position. The present invention is directed to this latter type of storage facility.

SUMMARY OF THE INVENTION

The present invention provides a semisubmersible combined loading, mooring and storage (LMS) facility which is capable of being used at deep and/or hostile offshore areas in the production of petroleum products, i.e., crude oil, especially in those areas where the laying of pipeline to shore is infeasible. The LMS facility may be used independently to receive crude oil directly from submerged wellheads or the like or it may be used in conjunction with other types of offshore production and storage structures.

For example, one application of the present LMS facility is to supplement the storage capacity of a production platform which itself includes storage tanks. Such a platform is one commercially known as Condeep and is presently in use in the North Sea. Although the storage capacity of such structures is substantial, there may be times due to extremely rough seas or weather that tankers are unable to offload crude from the platform storage tanks. If this occurs, production would have to be curtailed once the tanks on the platform were full. Also, special, expensive offloading structures, e.g., single-point moors or articulated platforms, which are spaced from the production platform, are normally required to offload crude from such platforms to a tanker. By using the present LMS facility with a production/storage platform, not only is the storage capacity at the production site considerably increased but, also, the need for a separate mooring and offloading structure is eliminated.

The present LMS facility is preferably of all welded steel construction which allows it to be built in many existing shipyards throughout the world without requiring special facilities or equipment and, accordingly, without the resulting expense. The LMS facility is constructed so as to have good stability during (1) towing to a production site, (2) submerging into position, and (3) operation.

Structurally, the LMS facility is comprised of a submerged storage section and a central tower section. The submerged storage section is comprised of a plurality of dual cargo (crude oil)/ballast (sea water) tanks which are joined together in a spaced relationship by structural members which define cofferdams or void spaces between adjacent tanks. A flexible diaphragm is installed in each dual tank and is positioned to prevent contact between crude and water as the capacity of each tank changes (one hundred per cent) from one fluid to (one hundred per cent) the other. A plurality of permanent ballast tanks are provided at the lower end of the submerged storage section below the dual tanks. The dual tanks are preferably sized so that when they are assembled the outer periphery of the submerged section is effectively a rectangle, preferably a square. This provides a structure which has the same good motion characteristics from substantially any direction which allows a tanker to approach from any direction for loading as dictated by weather. This provides good stability of the structure when it is submerged in its operable position.

The central tower section is connected at one end to the center of the submerged storage section and extends to a point substantially above the waterline when the LMS facility is in an operable position. When in an operable position, the submerged storage section will be at a depth which will be below the draft of a loaded tanker so that accidental collision between a tanker and the submerged storage section will be avoided. A superstructure, including the tanker loading and mooring means as well as housing for personnel, control spaces, etc., is mounted atop the central tower section.

Cargo (crude) only tanks are provided in the main portion of central tower section and all crude to the LMS facility is loaded and unloaded through these cargo only tanks. Also, the tower section houses workshops, pump rooms, stores, machinery rooms, etc.

The operation of LMS facility is as follows. The LMS facility, substantially empty except for permanent ballast, is towed to a production location and is semisubmerged by flooding the cofferdams between the dual tanks and by flooding the dual tanks with sea water. The sea water flows into LMS facility and fills the dual tanks forcing the diaphragm to the upside of the dual tanks. When the LMS facility is in this condition with all cofferdams flooded and the dual tanks filled with water, the profile of the LMS facility in the water is effectively fixed and due to the design of the LMS facility, the permanent ballast tanks, and the position of the crude only tanks, this profile will not change significantly as crude is loaded or offloaded from the LMS facility, as will be explained in more detail below.

The LMS facility is next anchored to the marine bottom by means of anchor chains extending from the corners of the submerged storage section. A flexible, submerged riser or the like is attached to the LMS facility through which crude is loaded into the LMS facility. The riser is preferably of the type which permits limited motion of the LMS facility and has sufficient length and flexibility to allow the LMS facility to surface when necessary without disconnecting the riser.

Crude is pumped through the riser into the cargo only tanks to accumulate crude which is then used for filling the dual tanks. Crude is pumped from the cargo only tanks into the dual tanks on the upperside of the diaphragm. The crude, as it enters the dual tanks, forces the diaphragms downward, thereby displacing water from the dual tanks. This allows the dual tanks to remain one hundred per cent full of liquids (be it crude, water, or a combination of both) during the entire sequence of operation. The flow of crude and water is controlled so that, due to the difference in their respective specific gravities, the total weight of the LMS facility remains substantially constant which in turn prevents any real change of the LMS facility's profile in the water. Also, the diaphragms prevent any contact between the crude and the water which is an important ecological consideration. The diaphragms are affixed to diametrically opposed edges in the dual tanks and the filling and discharge of crude and water are from the opposite, opposed edges of the dual tanks, as will be explained in more detail below.

In offloading crude from the LMS facility, a tanker is moored directly to the facility and a hose from a loading boom on the superstructure is connected to the tanker. The boom and mooring structure are movable on the superstucture so that the tanker may "weathervane" about the LMS facility during loading. Water is flowed into the dual tanks under the diaphragms to displace crude fom the dual tanks into the cargo only tanks. Crude is flowed or pumped from the cargo only tanks through the loading hose and onto the tanker.

BRIEF DESCRIPTION OF THE DRAWINGS

The actual construction, operation, and the apparent advantages of the invention will be better understood by referring to the drawings in which the numerals identify like parts and in which:

FIG. 3 is a plan view, partly in section, of the facility of FIG. 2, rotated 90° about a vertical axis;

FIG. 4 is a sectional view taken along section line 4—4 of FIG. 3;

FIG. 7 is a perspective view of a flexible diaphragm used in the dual tanks of the loading, mooring and storage facility of the present invention.

DESCRIPTION OF THE PREFERRED EMBODIMENT

Figure 1:
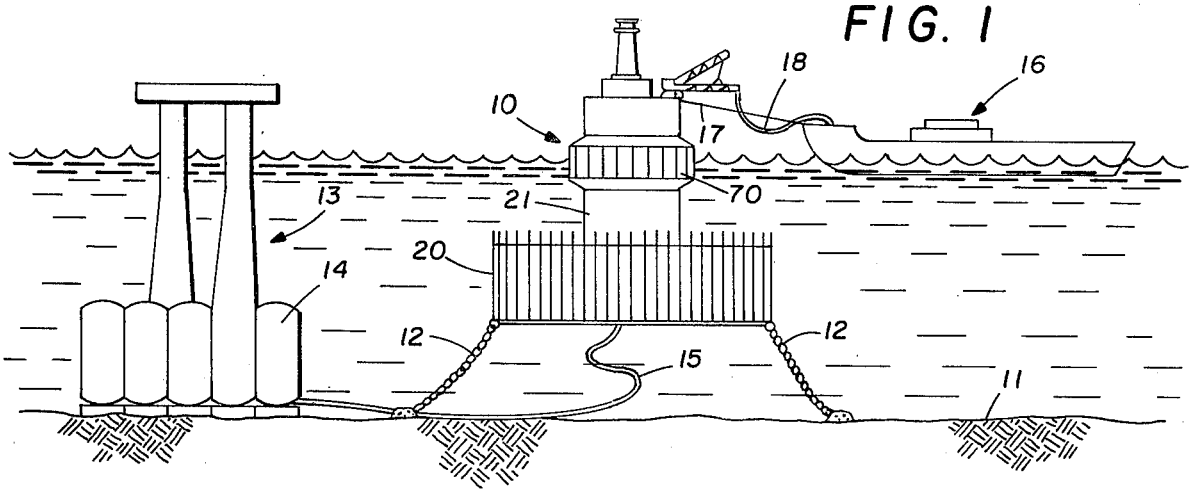
FIG. 1 is a perspective drawing of a typical application of the loading, mooring and storage facility of the present invention.

Referring more particularly to the drawings, FIG. 1 discloses semisubmersible, combined loading, mooring and storage (LMS) facility 10 as it might be used in the production of petroleum products from offshore deposits. As illustrated, LMS facility 10 is anchored by chains 12 to marine bottom 11 near production platform 13. Platform 13 is shown as the type which includes submerged storage tanks 14 which may be used to temporarily store produced fluids at the platform. LMS facility 10 is fluidly connected to storage tanks 14 by flexible line 15 and provides auxiliary and/or emergency storage capacity for platform 13 in the event that the production rate to platform 13 exceeds offloading and storage capabilities of platform 13. Products are offloaded from LMS facility 10 through offloading conduit 18 to tanker 16 which is moored to facility 10 by means of mooring line 17. Although LMS facility 10 is illustrated in conjunction with a production/storage platform, it should be recognized that the use of LMS facility 10 is not restricted to such situations but can be used in a wide range of offshore applications, e.g., (1) used as the sole offloading and storage facility for a production platform; (2) used independently of any platform structure or the like by receiving produced fluids directly from submerged wellheads; and (3) used as temporary storage near shore where land-based storage is infeasible for some reason, etc.

Figure 5:
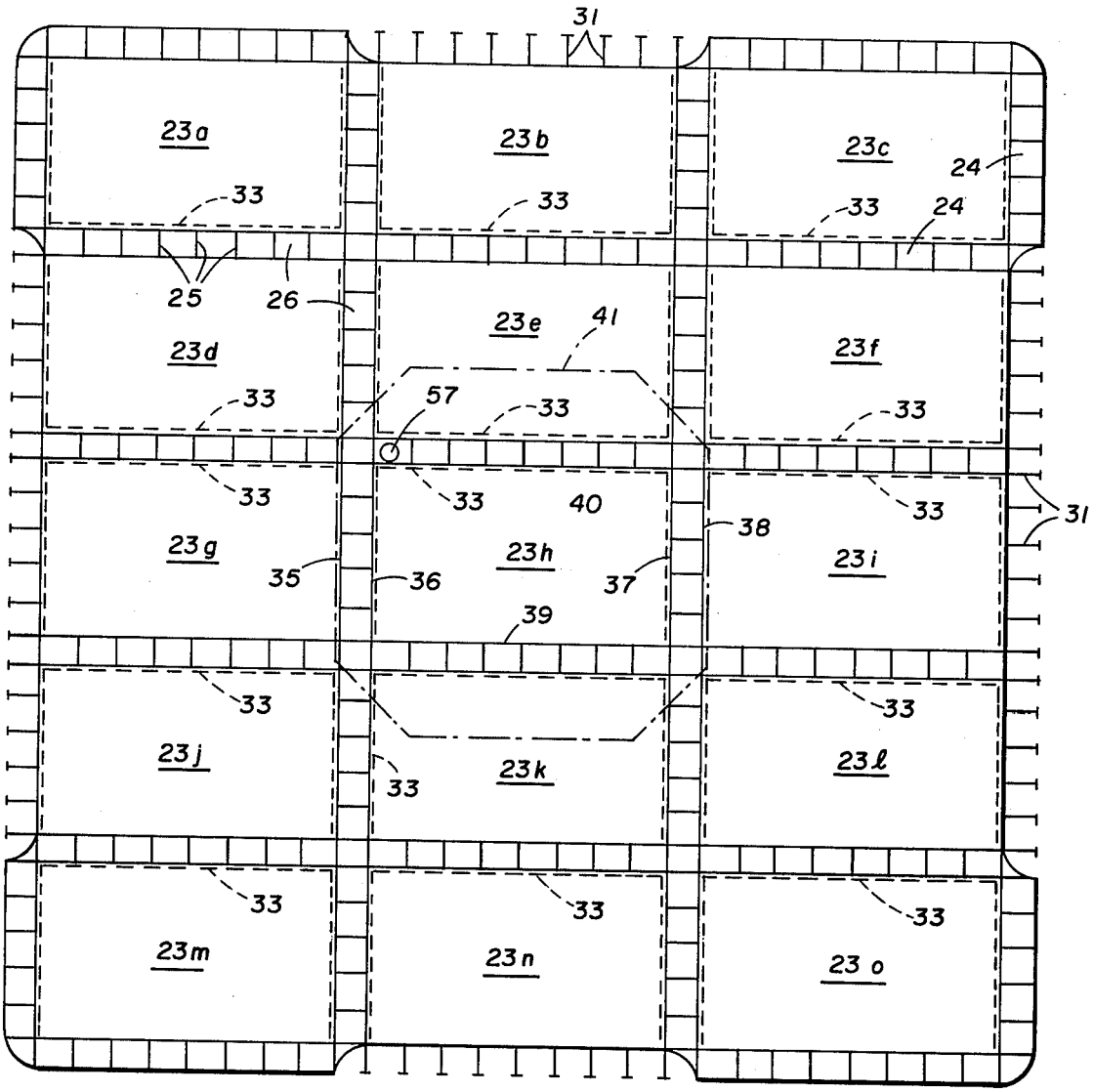
FIG. 5 is a sectional view taken along section line 5—5 of FIG. 3.
Figure 6:
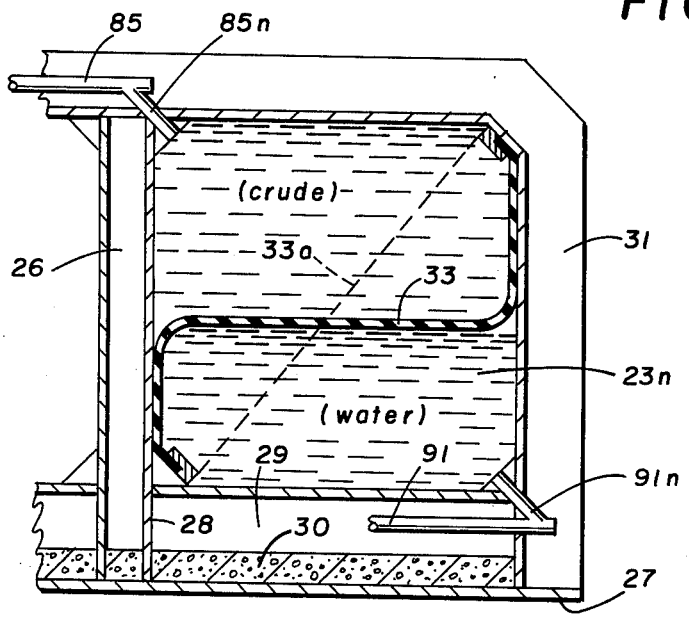
FIG. 6 is an enlarged sectional view taken along sectional line 6—6 of FIG. 2.

Referring now to FIGS. 2-6, the preferred construction of LMS facility 10 will be described. LMS facility 10 is comprised of submerged storage section 20 and central tower section 21. As best seen in FIG. 5, submerged storage section 20 is comprised of a plurality of dual cargo (crude oil)/ballast (sea water) tanks 23*a*–23*o*. Each of tanks 23 is made from mild steel plating 24 welded together to form generally rectangular tanks as shown. Plating 24 is assembled so that each tank 23 has a smooth inner surface and has no internal supports or stiffeners. A flexible but substantially inelastic diaphragm 33 is installed in each dual crude/water tank 23 (FIG. 6). Diaphragm 33 is comprised of a flexible material, e.g., polyethylene or neoprene rubber, which will withstand contact with oil and sea water for long periods of time without deterioration.

As best seen in FIG. 7, diaphragm 33 has a configuration substantially the same as one half of a dual tank 23 cut across a diagonal from one edge to an opposite edge. Diaphragm 33 is installed in dual tank 23 by sealingly affixing edges 33*c*, 33*d* to respective diagonally opposed edges (see FIG. 6) and sealingly affixing diagonal sides 33*a*, 33*b* along respective opposed sides of dual tank 23. By installing the diaphragms diagonally in dual tanks 23 which are smooth surfaced and which have a constant cross section and by sealing the edges of the diaphragms (e.g., with adhesive, clamps, bolts, or the like) in their respective tanks, dual crude/water tanks 23 can always remain one hundred per cent full whether full with crude, water, or a combination of both without ever allowing the crude and water to come in contact with each other, as will be explained in more detail below.

Dual crude/water tansk 23 are joined together by means of steel stiffeners or braces 25 which define void spaces or cofferdams 26 between adjacent dual tanks 23 as clearly seen in FIG. 5. The dimensions of each dual tank 23 are preferably selected so that when the desired number of dual tanks 23 are assembled, the outer configuration or periphery of section 20 is substantially rectangular in shape, preferably a square. This provides good stability for facility 10 when it is in a submerged operable position at an offshore site.

Figure 2:
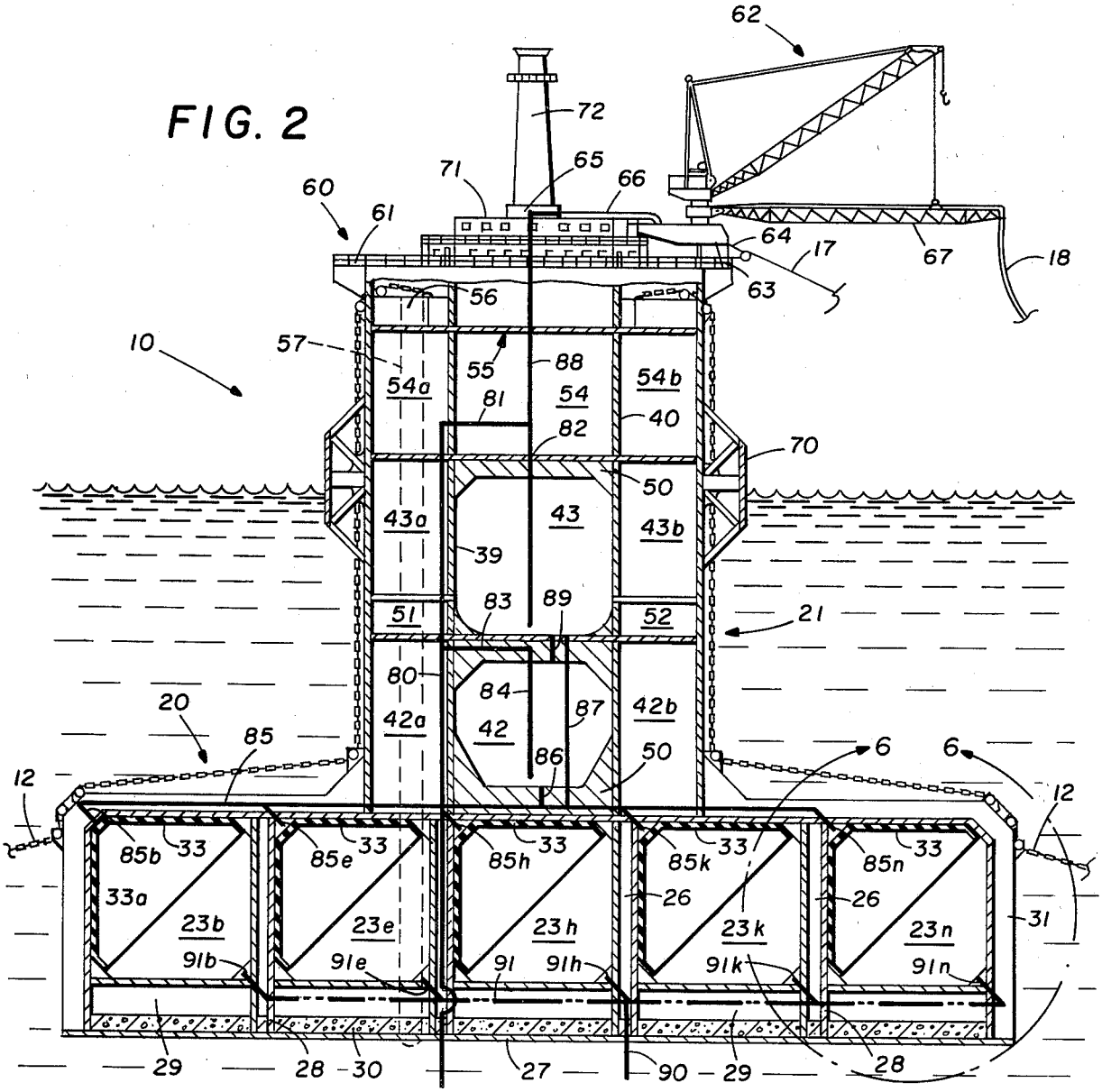
FIG. 2 is a plan view, partly in section, of the loading, mooring and storage facility of the present invention.

Bottom 27 of section 20 is also formed from mild steel plating and is spaced from and connected to the bottoms of assembled dual tanks 23 by means of steel braces 28 (see FIGS. 2 and 3). When assembled, tanks 23, bottom 27, and braces 28 define a plurality of permanent ballast tanks 29 which may be partially filled with solid ballast, e.g., concrete 30 or the like, to provide the desired profiles of LMS facility in the water during both towing to site and during operation. The remaining space in permanent tanks 29 preferably is filled with water but, as understood in the art, provisions can be included to flood and drain these spaces as desired.

To further strengthen submerged storage section 20 and to protect dual crude/water tanks 23 from damage due to accidental collision, a plurality of steel plates or stiffeners 31 are welded about the outer periphery of section 20. Stiffeners 31 are also placed on the outside of the main submerged section to strengthen the outer dual tanks while keeping the internal surfaces of the dual tanks free of stiffeners so that the dual tanks will have uniform dimensions and diaphragm size providing for ease of operation.

Central tower section 21 is connected to submerged storage section 20 and extends upward to a point substantially above the waterline when facility 10 is in an operable position. Tower section 21 is preferably formed from high tensile steel which assists in reducing the weight of the upper structure, thereby improving stability by providing a lower center of gravity for LMS facility 10. To insure good structural integrity between submerged storage section 20 and tower section 21, structural members 35, 36, 37, 38, 39, and 40 (FIGS. 2, 3, and 4) are integral extensions of the plating 24 which forms part of tanks 23 and extends through section 20 to bottom 27, see the broken line 41 in FIG. 5 which represents the cross-section configuration of tower section 21 in relation to submerged storage section 20.

A plurality of crude only tanks are provided in tower section 21 and are preferably arranged in two similar levels. As shown, one level is comprised of major crude only tank 42 and two auxiliary crude only tanks **42*a*, 42*b*, with a second or upper level being comprised of major crude only tank 43 flanked by auxiliary crude only tanks 43*a*, 43*b*. Since no diaphragms are installed in these tanks, crude only tanks may include internal stiffeners 50 (see FIGS. 2, 3, and 4) or reinforcements to meet necessary strength requirements. Located between auxiliary crude only tanks 42*a* and 43*a* is room 51, preferably for housing necessary pumping equipment; and located between auxiliary crude only tanks 42*b* and 43*b* is room 52, preferably for housing necessary ballast monitoring equipment (see FIG. 2**), as understood by the art.

As illustrated, the area **54, 54*a*, 54*b* immediately above crude only tanks 43, 43*a*, 43*b* is undesignated but is preferably used to house draft-correction ballast tanks and, in addition, provides LMS facility 10 with growth potential should it become desirable to equip LMS facility 10** with crude processing and/or drilling equipment.

Upper deck 55 of tower section 21 provides the necessary space for machinery, stores, workshops, etc., as well as providing an entrance 56 (see FIGS. 3 and 4) to trunk 57 which extends through tower section 21 and submerged storage section 20 to bottom 27. Through trunk 57, divers have access to the underside of LMS facility 10 where they can inspect and make repairs where necessary.

Forming the uppermost part of tower section 21 is superstructure 60 which comprises the mooring and loading deck 61 of LMS facility 10. Boom and mooring structure 62 is movably mounted on track 63 which extends 360° around deck 61. Mooring line 17 (FIG. 1) is affixed to boom and mooring structure 62 at element 64 (FIGS. 2 and 4). A universal fitting 65 supplies crude from the crude only tanks in LMS facility 10 to pipe 66 in boom 67 to offloading conduit or hose 18 for loading tanker 16 as will be explained in more detail below. Crane **62*a* may be fixed during periods of nonactivity, with boom 67 stowed on deck (not shown) away from weather and sea. When tanker 16 is moored and loading, however, boom and mooring structure 62 will be automatically rotated around track 63 so that tanker 16** may "weathervane" during the loading cycle.

Fitted around tower section 21 is fender structure 70 which is positioned so that it will lie at the waterline when LMS facility 10 is submerged in an operable position. Fender 70 provides a mean for supply boats and work boats to tie up directly alongside to offload supplies, provide auxiliary support, etc. Fender around tower can also be constructed to form buoyancy tanks to aid in regulating the operating draft of LMS facility 10.

Staterooms 71 and other life support facilities for necessary personnel as well as control tower 72 are provided atop superstructure 60. A helipad (not shown) may also be incorporated on superstructure 60.

For the sake of clarity, a highly simplified schematic of the necessary piping for the loading and offloading of LMS facility 10 is shown in heavy lines in FIG. 2. The piping preferably will utilize available cofferdams throughout LMS facility 10 for pipe tunnels.

Crude supply line 80, adapted to be connected to riser 15 (FIG. 1), enters submerged storage section 20 and extends upward into tower section 21. Lines 81, 83 connect crude supply line 80 to inlets 82, 84 of crude only tanks 43, 42, respectively, for supplying crude to said crude only tanks. Inlets 82, 84 are shown as extending to near the bottoms of crude only tanks 43, 42, respectively, so that a single line may be used to either fill or empty said tanks; however, it should be recognized that separate lines could be used if desired. Further, the filling and emptying lines for auxiliary crude only tanks **43*a*, 43*b*, 42*a*, 42*b*, as well as the valving, pumps, etc., have not been shown for clarity's sake, but it should be recognized that such lines, etc., would be present as needed for each of the crude only tanks within tower section 21. Line 89 connects crude only tanks 43, 42**, together so crude may be moved between tanks when desired.

A crude manifold 85 is connected to crude only tanks 43, 42 by means of lines 87, 86, respectively. Crude manifold 85 is also connected to each of dual tanks **23*a–o*. As shown in FIG. 2, crude manifold 85 is connected to dual tanks 23*b, e, h, k, n* by means of crude inlets 85*b, e, h, k, n*, respectively. Also, a water manifold 91 is provided in submerged storage section 20 and has a water supply line 90 which is in fluid communication with the body of water in which LMS facility 10 is to be used. Water manifold 91 is connected to each of dual tanks 23*a–o*. In FIG. 2, dual tanks 23*b, e, h, k, n* are shown connected to water manifold 91 by means of water inlets 91*b, e, h, k, n*, respectively. As best seen in FIG. 6, crude inlet 85*n* from crude manifold 85 and water inlet 91*n* from water manifold 91 are positioned to enter dual tank. 23*n* through the diagonally opposed edges of dual tank 23*n* which are opposite the edges of dual tank 23*n* to which diaphragm 33 is affixed. This prevents the filling and emptying of the dual tanks with both crude and water from being adversely affected by unforeseen action of the diaphragm. Further, the positioning of the crude and water inlets permit effectively all of the crude or all of the water to be displaced by the other liquid from dual tank 23*n*** during a desired operation.

The operation of LMS facility 10 is as follows. LMS facility 10, essentially empty except for permanent ballast, is towed to a production location and is semisubmerged by flooding cofferdams 26 between dual tanks 23 and by filling dual tanks 23 with sea water. The sea water flows through line 90, water manifold 91, water inlets 91*n* et al, and into dual tanks 23, thereby forcing diaphragms 33 to the upside of dual tanks 23. When LMS facility 10 is in this condition with all cofferdams 26 is flooded and dual tanks 23 filled with water, the profile of LMS facility 10 in the water is effectively fixed and due to the design of LMS facility 10, permanent ballast tanks 29, and the position of crude only tanks 42, 43, this profile will not change significantly as crude is loaded or offloaded from LMS facility 10, as will be explained in more detail below.

LMS facility 10 is next anchored to the marine bottom by means of anchor chains 12 extending from the corners of submerged storage section 20. Flexible, submerged riser 15, or the like, is attached to crude supply line 80 in LMS facility 10. Crude is flowed through riser 15 into one or both of crude only tanks 42, 43 where crude is accumulated until its weight becomes such that it would begin to affect the profile of LMS facility 10. At this point, crude is pumped into crude manifold 85 from crude only tanks 42 and/or 43. Crude from crude manifold 85 is forced through crude inlets 85*n* et al into dual tanks 23 on the upper side of diaphragms 33, forcing diaphragms 33 downward to displace water from dual tanks 23 through wter manifold 91 and line 90. Crude is supplied to dual tanks 23 in an amount so that the weight of said amount plus the weight of the crude in the crude only tanks will remain approximately equal the weight of the water being displaced from dual tanks 23. (Note that the specific gravity of sea water is approximately 1.0 while the specific gravity of crude is approximately 0.8.) Filling of LMS facility 10 may be continued until all dual tanks 23 and all crude only tanks 42, 42*a*, 42*b*, 43, 43*a*, 43*b* are completely filled at which time the total weight of the crude will be approximately the same as the weight of the water originally in the dual tanks. Of course, water may also be removed from permanent ballast tanks 29 and/or from cofferdams 26, if necessary, to maintain the proper weight distribution.

In offloading crude from LMS facility 10, tanker 16 is moored by line 17 directly to LMS faciltiy 10 and offloading conduit 18 is connected to tanker 16 as is understood in the art. As explained above, boom and mooring structure 62 is movable on the superstructure so that tanker 16 may "weathervane" about LMS facility 10 during loading. Crude is pumped from crude only tanks 43 and/or 42 through line 88, universal fitting 65, pipe 66, and conduit 18 onto tanker 16. As crude is removed from the crude only tanks, water (either under its own head or assisted by pumps) flows into dual tanks 23 through water manifold 91 to force diaphragms 33 toward the top of dual tanks 23 which, in turn, displace crude form dual tanks 23 into crude only tanks 42 and/or 43 through lines 86 and/or 87. Again the weight of the water admitted into dual tanks 23 is regulated to coincide with the weight of the crude being removed from the dual tanks and the crude only tanks. This allows LMS facility to retain substantially the same profile in the water during offloading of crude onto tanker 16.

By accumulating crude in the crude only tanks and by loading crude to a tanker from the crude only tanks, the respective volumes (weights) of crude and water can be controlled in the dual tanks to provide a facility of good stability and constant profile during both loading and offloading the facility. Also, by providing diaphragms in those tanks which at some time will contain both crude and water, contact between the crude and water is avoided at all time. In the event a diaphragm should become damaged, tha particular dual tank can be isolated from the rest of the crude tanks until repairs are made so that the danger of pollution at the operational site is greatly reduced.

What is claimed is:

1. A semisubmersible storage facility comprising:

a submerged storage section comprising:

a plurality of dual crude/water tanks;

a flexible diaphragm installed internally in each of said plurality of dual crude/water tanks, said diaphragm being postioned to continuously separate crude from water as the fluids in each dual crude/water tank charges from substantially one hundred per cent crude to substantially one hundred per cent water or from one hundred per cent water to one hundred per cent crude; and means for spacing and connecting said dual crude/water tanks together to form said submerged storage section having void spaces defined between adjacent dual crude/water tanks, said void spaces adapted to be flooded with water;

a central tower section affixed at its lower end to said submerged storage section and extending to a point substantially above the waterline when said facility is in an operable position;

a plurality of crude only tanks positioned in said central tower section;

means adapted to be connected to a crude supply source for filling said crude only tanks with crude;

means for fluidly connecting said crude only tanks to the upper side of said diaphragm in each of said dual crude/water tanks in said submerged storage section for moving crude to or from each of said dual crude/water tanks whereby said dual crude/water tanks can be filled with or emptied of crude from said crude only tanks; and means adapted to be connected to a water supply source for supplying or draining water to or from the lower side of said diaphragm in each of said dual crude/water tanks.

2. The semisubmersible storage facility of claim 1 including:

a plurality of permanent ballast tanks in said submerged storage section.

3. The semisubmersible storage facility of claim 1 wherein said flexible diaphragm comprises:

a diaphragm comprised of a flexible, inelastic material resistive to both crude and water, said diaphragm having a configuration conforming essentially to the interior of one half of one of said dual crude/water tanks, said diaphragm being affixed to diagonally opposed, upper and lower edges, respectively, of said dual crude/water tank and diagonally along opposed sides of said dual crude/water tank between said opposed edges.

4. The semisubmersible storage tank of claim 3 wherein said means for fluidly connecting said crude only tanks to each of said dual crude/water tanks comprises:

a crude manifold in said submerged storage section;

means for fluidly connecting said crude only tanks to said manifold; and a fluid inlet for each dual crude/water tank extending from said crude manifold into said dual crude/water tank, said fluid inlet entering said dual crude/water tank at the upper edge of said dual crude/water tank which is opposite to said upper edge of said dual crude/water tank to which said diaphragm is affixed;

and wherein said means for supplying water to each of said dual crude/water tanks comprises:

a water manifold in said submerged storage section;

means for fluidly connecting said manifold to a water supply source; and a water inlet for each dual crude/water tank extending from said water manifold into said dual crude/water tank, said water inlet entering said dual crude/water tank at the lower edge of said dual crude/water tank which is opposite to said lower edge of said dual crude/water tank to which said diaphragm is affixed.

5. The semisubmersible storage facility of claim 4 including:

a plurality of permanent ballast tanks in said submerged storage section.

6. The submersible storage facility of claim 5 including:

means for anchoring said semisubmersible storage facility to the marine bottom.

7. The semisubmersible storage facility of claim 6 including:

a superstructure mounted on the top of said central tower section;

means on said superstructure for mooring a vessel to said storage facility; and means on said superstructure for loading crude from said crude only tanks onto said vessel.

8. The semisubmersible storage facility of claim 7 wherein said dual crude/water tanks are formed of welded construction from steel plating, said steel plating of some of said plurality of dual crude/water tanks extending upward to form structural members of said central tower section, thereby serving as means for affixing said central tower section ot said submerged storage section.

9. The semisubmersible storage facility of claim 8 including:

a fender structure mounted about said central tower section at a point which will lie adjacent the waterline when said storage facility is submerged in its operable position.

10. The semisubmersible storage facility of claim 9 including:

a trunk extending through said semisubmersible storage facility from a point near the top of said central tower section to the bottom of said submerged storage section to provide access for personnel to the underside of said storage facility.

11. The semisubmersible storage facility of claim 10 wherein each of said plurality of dual crude/water tanks is of a substantially rectangular configuration and of such dimensions whereby the periphery of said submerged storage section will form substantially a square when said plurality of said dual crude/water tanks are assembled.

12. In a semisubmersible storage facility having a submerged storage section having a plurality of dual crude/water tanks and a central tower section having at least one crude only tank, the method of loading said facility comprising:

flooding said dual crude/water tanks with water to submerge the storage facility into an operable position having a defined profile with relation to the waterline;

flowing crude into said at least one crude only tank to accumulate a volume of crude therein; and flowing crude from said at least one crude only tank to said plurality of said dual crude/water tanks to displace the water in said dual crude/water tanks, said crude being flowed into said dual crude/water tanks at a rate which maintains the combined weight of the crude in said at least one crude only tank abd the weight of the crude in said dual crude/water tanks approximately equal to the weight of the water being displace from said dual crude/water tanks whereby said profile of said storage facility remains substantially constant during loading of said storage facility.

13. In a semisubmersible storage facility having a submerged storage section having a plurality of dual crude/water tanks filled with crude and a central tower section having at least one crude only tank, the method of offloading said facility comprising:

flowing water to said plurality of dual crude/water tanks to displace crude from said plurality of dual crude/water tanks to said at least one crude only tank; and offloading crude from said crude only tank at a rate which maintains the combined weight of the crude in said at least one crude only tank and the weight of the crude in said plurality of dual crude/water tanks approximately equal to the weight of the water being flowed into said plurality of dual crude/water tanks whereby said profile of said storage facility remains substantially constant during offloading of said storage facility.

* * * * *